United States Patent [19]

Keller

[11] 4,323,359

[45] Apr. 6, 1982

[54] MACHINE FOR THE CONTINUOUS WET TREATMENT OF TEXTILE THREAD FORMATIONS, THE PROCESS FOR OPERATING THE MACHINE, AS WELL AS A NON-TOUCHING CATCH-THREAD DEVICE

[75] Inventor: Werner Keller, Winterthur, Switzerland

[73] Assignee: Jaeggli Maschinenfabrik AG, Räterschen, Switzerland

[21] Appl. No.: 127,559

[22] Filed: Mar. 6, 1980

[30] Foreign Application Priority Data

Mar. 23, 1979 [CH] Switzerland ..... 2716/79

[51] Int. Cl.[3] ..... D06B 23/04

[52] U.S. Cl. ..... 8/155; 68/199; 68/205 E; 242/47.1

[58] Field of Search ..... 8/151.1, 155, 151.2; 68/176, 205 E, 62, 149, 163, 199, 206; 242/47.03, 47.1, 47.11

[56] References Cited

U.S. PATENT DOCUMENTS 2,346,696 4/1944 Moritz et al. ..... 68/176 X 2,563,039 8/1951 Hudson ..... 68/205 E X

*Primary Examiner*—Philip R. Coe

*Attorney, Agent, or Firm*—Bachman and LaPointe

[57] ABSTRACT

A machine for the continuous wet treatment of textile thread formations has two wet treatment stations each with a reel and three rotating rollers to take up a thread formation. A drive permits running either the reel or the rollers. A thread-laying device can be synchronized with the rotation of the reel by means of cog wheels. Each reel has a driven squeezing part. A drying station follows the wet stations with two thread take-up rollers and a spool station. The purpose of this machine is to treat, specifically to mercerize thread. The machine does not produce in excess nor does it produce substandard quality.

4 Claims, 17 Drawing Figures

MACHINE FOR THE CONTINUOUS WET TREATMENT OF TEXTILE THREAD FORMATIONS, THE PROCESS FOR OPERATING THE MACHINE, AS WELL AS A NON-TOUCHING CATCH-THREAD DEVICE

BACKGROUND OF THE INVENTION

The present invention deals with a machine for the continuous wet treatment of textile thread formations, as well as a process for operating the machine and a non-touching catch-thread device.

Thread mercerizing machines which are similar in design to piece mercerizing machines are well known. Their production rates are extremely high, producing mercerized goods in the order of 150 tons a week, a production rate which is really too high for many operations. For this reason this machine has found a place in only few plants. This machine is not technically suitable for the market as the quality of the thread mercerized in this machine is unsatisfactory due to the fact that the thread is not (pre-)shrunk or (over-)stretched to any degree. As a result, the fibers on the surface of the thread swell up immediately when dipped into the lye during mercerizing in this machine thereby preventing the swelling of the fibers in the middle of the thread. The tension in the thread which causes the fibers to adhere together and causes the openings for air to close between the fibers is only equal to the magnitude of the shrinkage since the thread is not overstretched by the machine. The increase in the tensile strength of the thread is therefore only 3 to 4%. Furthermore, a surface-mercerized thread which has been mercerized in this machine loses its shine after a few washings because the surface of the thread has also been affected by pressing, pulling and bending. This thread cannot be sold as quality merchandise, at least not in Europe.

There is another type of mercerizing machine in which only a single thread is treated and drawn off cones and is wound up onto cylindrical spool. In this case the thread runs at a speed of about 800 meters per minute over two cylinders, the axes of which can be regulated with respect to each other, so that the thread is placed under tension. However, the resulting merchandise is again unsatisfactory and, therefore the problem of poor quality still exists.

There exists a device that is used to treat thread, in which the various parameters which change and characterize thread cannot be changed singly and independent of each other. If the thread is shrunk with this device so as to keep the degree of mercerization high the tensile strength is correspondingly lowered. Again, it is the tension in the thread which causes the fibers to lie together and the openings for air between the fibers to close, and it is equivalent to the amount of shrinkage, since no machine has overstretched the thread and vice versa. (German DE-OS No. 25 27 450)

The above holds true for the well-known Dixie mercerizing process, as it is described in Great Britain Pat. No. 696 595, for example. None of these known devices employs a multi-roller reel, by way of example, as will be described in detail hereinbelow with reference to the present invention.

SUMMARY OF THE INVENTION

The present invention is drawn to a machine for the continuous mercerization of thread under conditions which eliminate the above disadvantages which lead to large production on the one hand and poor quality on the other hand.

In this case, "treatment" is to be understood as every wet treatment of thread formations.

"Optimum Mercerization" is achieved on the one hand through chemical treatment of the cotton thread and on the other hand through mechanical treatment. The mechanical treatment is accomplished primarily through the use of the machine of the present invention. The process of the present invention comprises uniform wetting of the thread formation to obtain the greatest amount of shrinkage, and sufficient squeezing of the thread formation to obtain uniform tension. The chemical treatment, which is more difficult to control, encompasses the application of lye and rinsing with water. The mercerized cotton thread processed in accordance with the present invention is characterized by a fiber-glass-like fiber surface, an increased resistance to rubbing (friction), an increased resistance to tearing and an increased ability to accept pigments (dyes) based on the degree of mercerization.

By determining the (degree of) mechanical and chemical influence, it is possible to pay special attention to one parameter or a sensible combination of these parameters, depending on the need. The most important prerequisite for quality in a mercerized cotton thread is uniformity. This can only be achieved through constant (operational) plant conditions.

In addition, the make-up and treatment of the raw thread is of pre-eminent importance.

BRIEF DESCRIPTION OF THE DRAWINGS

The present invention will be described in detail with reference to the following drawings wherein.

DETAILED DESCRIPTION

Figure 2:
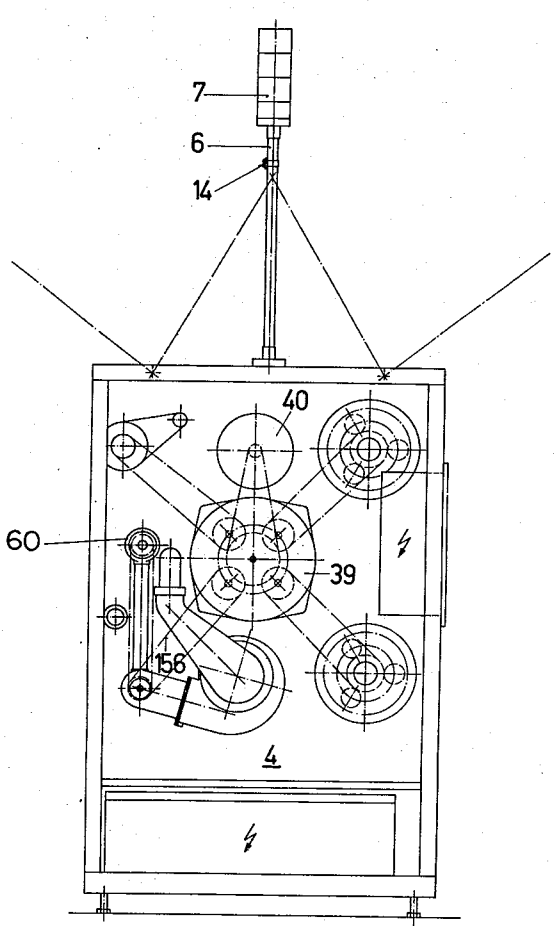
FIG. 2 is a view of the thread treating machine of FIG. 1, seen from the drive side.
Figure 1:
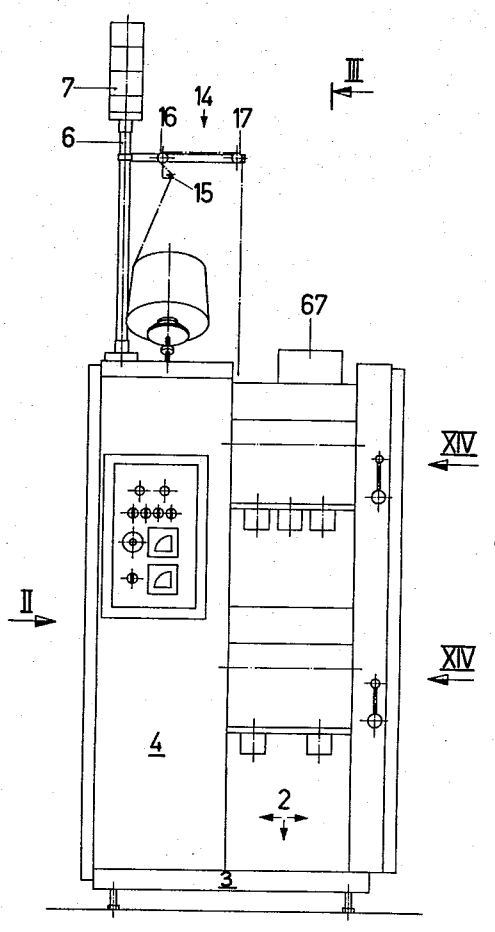
FIG. 1 is a view of the thread treating machine.

The thread-treating machine shown in FIGS. 1, 2 is for the wet treatment of thread formations. This can include either vegetable or synthetic threads or fibers. Several single threads can also be included in the term thread formations. The wet treatment can consist of mercerizing, dyeing or other thread treatments, where a drying station and a spool station can be attached to the wet station or stations.

The thread treating machine 1 is made up of a machine base 2 with a ground plate 3 and a motor housing 4. A mast 6 is on top of the housing with a signal lamp 7 which shows the operating condition of machine 1. Also on top of the motor are two spool carriers 9 and 10, symmetrical about mast 6, which carry spools 11 and 12. There is also a device for drawing off thread 14 clamped to mast 6 on top of housing 4; this is equipped with a thread guide 15 and a thread brake 16 which consists of a plate brake in this case. In addition, a deflecting roller 17 is related to the thread drawing-off device 14.

Figure 4:
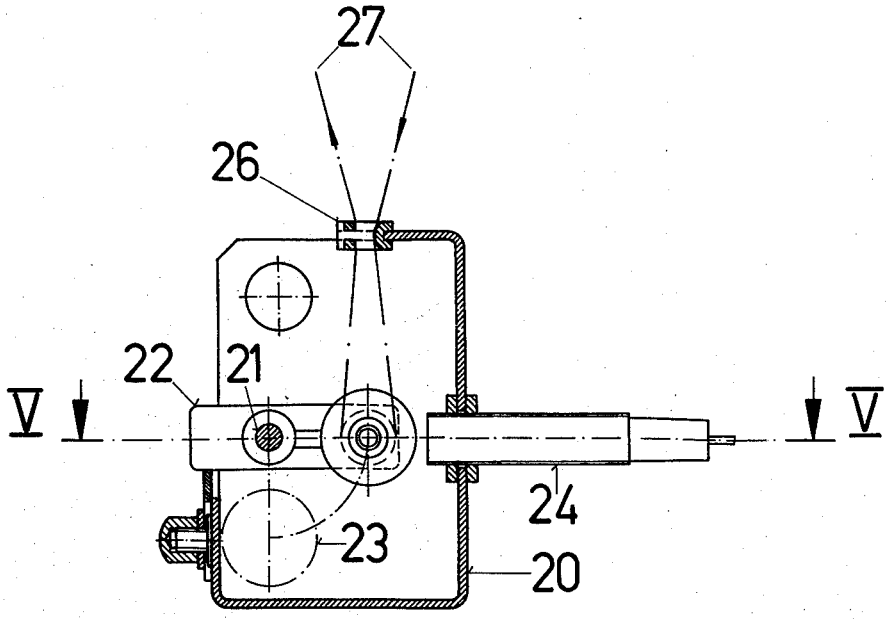
FIG. 4 is a view of the thread monitoring station taken along line IV—IV of FIG. 5.
Figure 5:
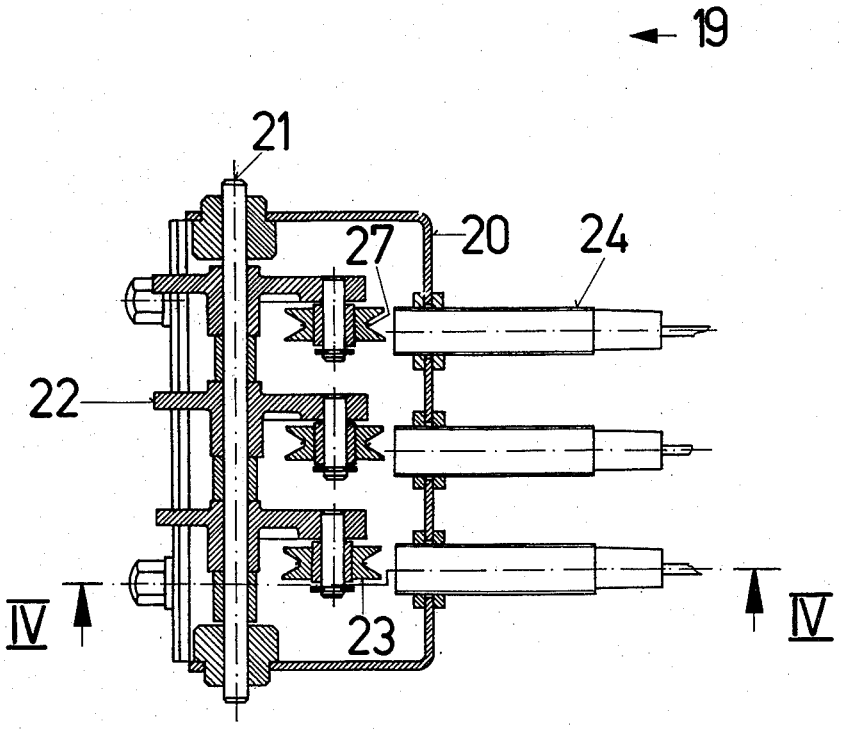
FIG. 5 is a view of the thread monitoring station taken along line V—V in FIG. 4.

A thread monitoring station 19 is intended for the area of the ground plate 3 at the motor housing 4. Referring to FIGS. 4 and 5 the monitoring station comprises a housing 20 having a shaft 21 journaled therein to which three swivelling levers 22 are attached. The free ends of the swivelling levers 22 each carry a diverting roller 23. The swivelling levers 22 are in a horizontal position while in operation. There are switches opposite the diverting rollers 23 which are of capacitative nature, for example, or which can also be set up as optical elements. The function of the switches is to monitor the thread to sense when the swivelling lever 22 drops into its vertical position, shown by phantom lines in FIG. 4, of its own weight, if the thread being led around the diverting roller 23 should tear.

Upon sensing the swivelling lever in its vertical position, the switch will act to shut down the machine.

Figures 8, 9, 10, 11:
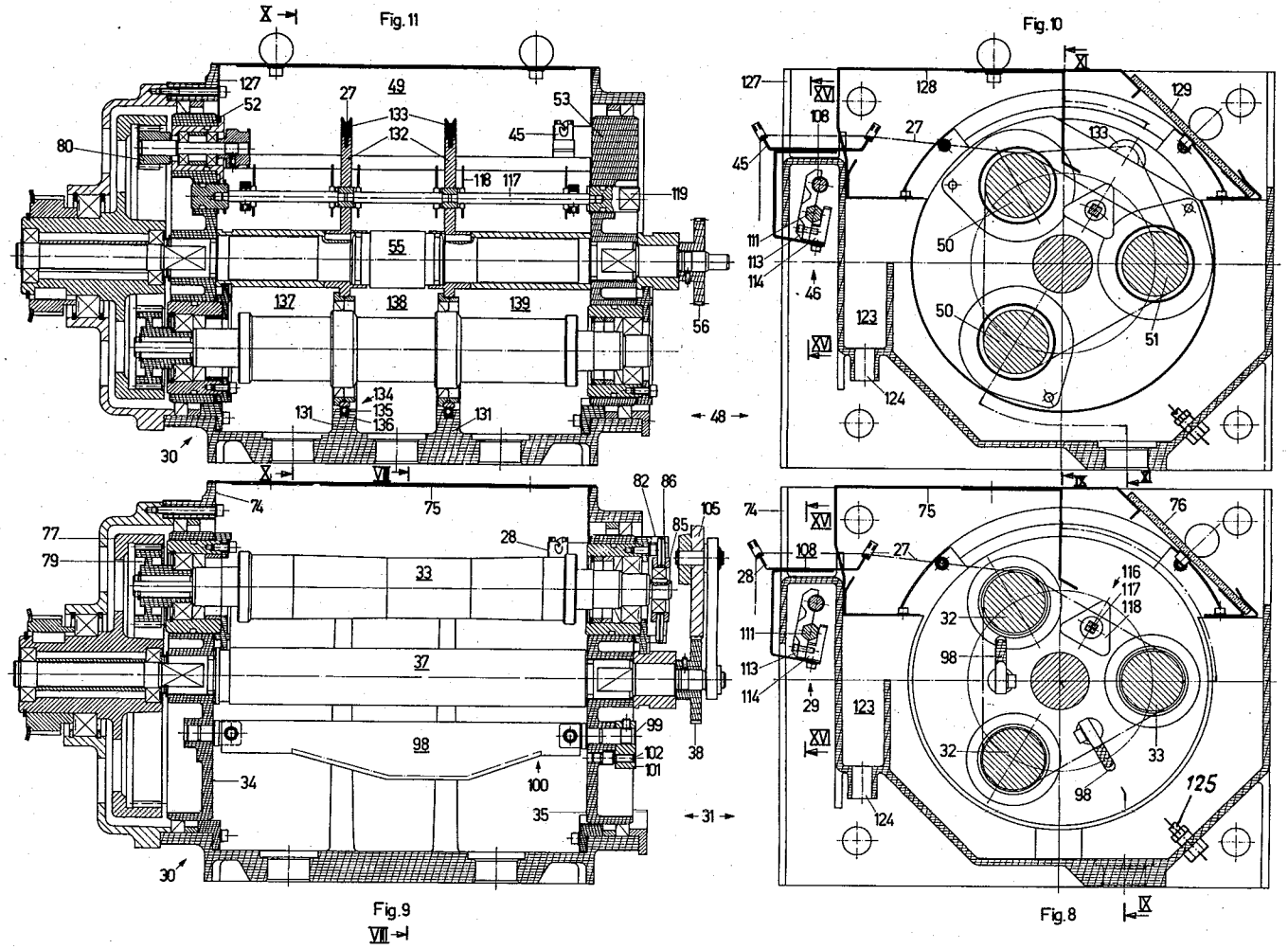
FIG. 8 is a cross sectional view of a mercerizing station taken along line VIII—VIII in FIG. 9.
FIG. 9 is a cross sectional view of the mercerizing station of FIG. 8 taken along line IX—IX.
FIG. 10 is a cross sectional view of a wash station taken along line X—X in FIG. 11.
FIG. 11 is a cross sectional view of the wash station of FIG. 10 taken along line XI—XI.

An additional thread guide 28 is attached above the thread monitoring station 19 on top of a laying device 29. This forms part of a mercerizing station 31. In FIGS. 8 and 9, a thread roller 33 with blocking devices and two thread rollers 32 without such blocking devices are shown in these views of station 31. The three rollers 32 and 33 can rotate, and they rest in two bearing rings 34, 35. The two bearing rings 34, 35 are firmly connected to a central spindle 37. A cog wheel 38 is attached to the protruding, free end of the spindle. The other end of the central spindle 37, as shown in FIG. 2, is effectively connected to a drive motor 40 via a central intermediate gear 39. This drive motor 40 is the central drive of thread treating machine 1.

It is possible to set up several, preferably two, such thread treating machines next to each other and to connect their intermediate gears via a central spindle to a central drive motor.

Figure 3:
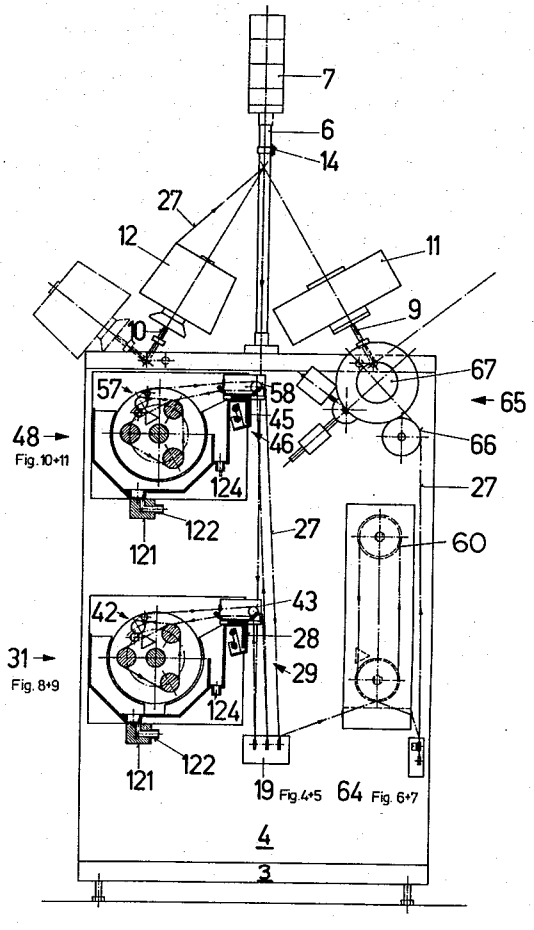
FIG. 3 is a cross sectional view taken along line III—III of FIG. 1.
Figure 17:
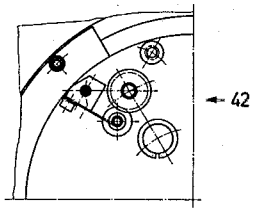
FIG. 17 is a detailed view of squeeze rollers.

Squeeze rollers 42, as shown in FIGS. 3 and 17 which are driven in their turn, are in pivot bearings attached to one of the bearing rings 34, 35. A diverting roller 43 is attached downstream of the squeeze rollers.

A wash station 48 which is subdivided into several chambers is, as illustrated in FIG. 3, above the mercerizing station 31; of course, other arrangements are also possible. A thread guide 45 on top of a laying device 46 is located in front of station 48, similar to that described in the case of mercerizing station 31 and thread guide 28.

With reference to FIGS. 10 and 11 wash station 48 with a chamber 49 (a plurality of chambers could be used) has a thread roller 51 and two freely-turning thread rollers 50, similar to rollers 33 and 32 in mercerizing station 31. The three rollers rotatably rest in two bearing rings 52 and 53. The two bearing rings 52 and 53 support a central spindle 55. one end of this spindle has a cog wheel 56, while the other end is also connected to the drive motor 40 via intermediate gear 39 as seen in FIG. 2. The two stations 31 and 48 can be switched individually to and from the drive. On one of the bearing rings 52, 53 there is rotatably mounted the squeeze rollers 57, followed by a diverting roller 58 in the same manner as squeeze rollers 42 and diverting roller 43.

With reference to FIGS. 2, 3, 12 and 13, there is a drying station 60 in the drive housing 4 with two perforated rollers 61 and 62 attached to spindles. There is a thread monitor 64 at the same height as station 19, similar to the thread monitoring station 19 for the mercerizing and wash stations. The purpose of the thread monitor is to monitor the space between drying station 60 and a subsequent spool station 65. The spool station 65 has a drive 66, a spool 67 to take up the thread and a thread layer, which, combined with the drive 66, makes up a thread laying drum.

Figure 6:
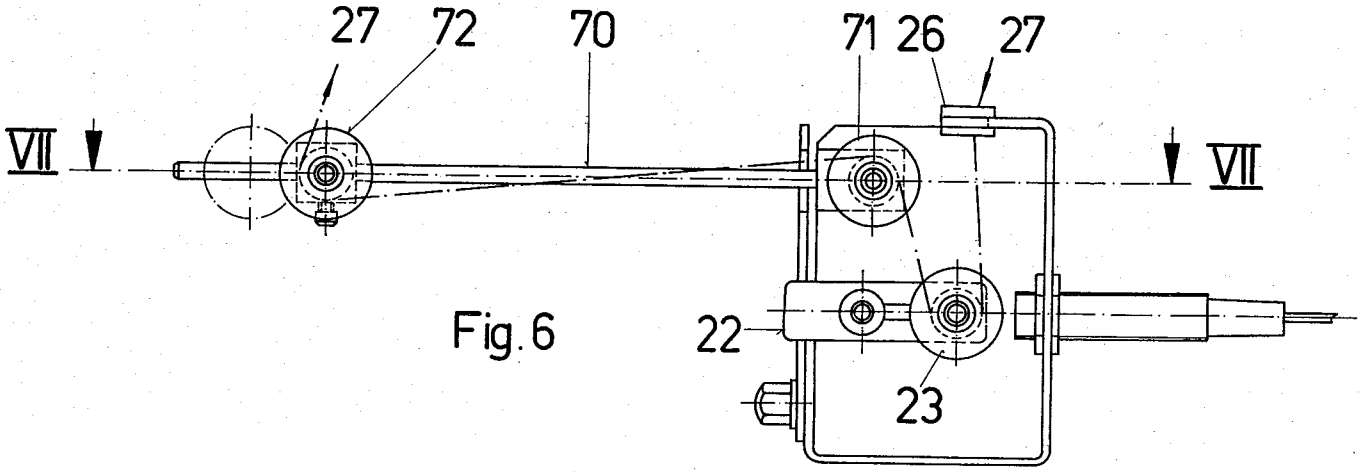
FIG. 6 is an additional view of the thread monitoring station of FIG. 4.
Figure 7:
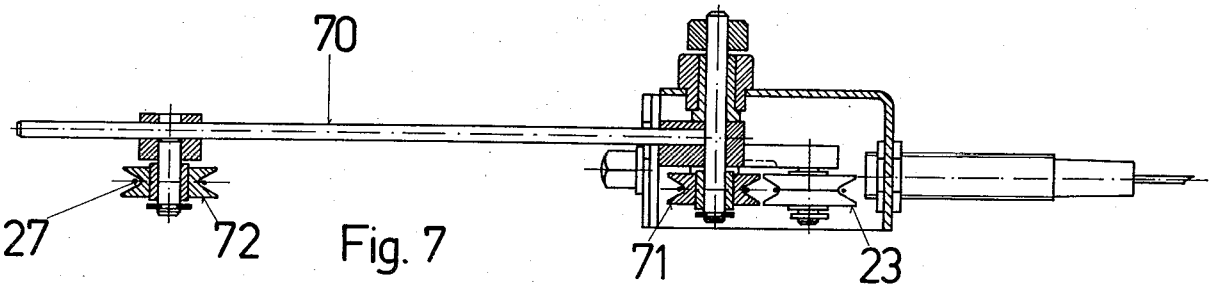
FIG. 7 is a view of the thread monitoring station taken along line VII—VII in FIG. 6.

As can be seen in FIGS. 6 and 7 the thread monitor 64 is constructed somewhat differently from thread monitoring station 19. It has a compensation lever 70 in addition, as well as a rigidly attached diverting roller 72 which can be moved on it.

As shown in FIGS. 8 and 9, a housing 74 which is open at the top is provided with a cover 75 and a clear slip-on disk 76 so as to enclose the mercerizing station 31. There is a drive cog wheel 77 on a pivot bearing on the central spindle 37. This cog wheel is engaged with the pinions 79 of the three thread rollers 32, 33. A further pinion gear 80 on the rotating spindle of the squeeze rollers 42 is also meshed with drive cog wheel 77. With reference to FIG. **14*a* bearing bushing 82, which is attached to thread roller 33 as part of bearing ring 35, has been fitted with two opposing radial slots 83. This bearing bushing 82 is for seating a free-running bearing ring 85 which has been fitted by two opposing radial ratchet pegs 86. The two pegs 86 fit into slot 83 when bearing ring 85 has been pushed up. When the bearing ring 85 is turned in the appropriate direction, there is a blocking of the wedge, so that the thread roller 33 is kept from turning because of ratchet peg 86. In this blocked position of thread roller 33, in which the two thread rollers 32 are also kept from turning, the drive cog wheel 77 drives the central spindle 37 via the blocked thread rollers 32, 33 and the two bearing rings 34, 35. As a result, the thread rollers 32, 33 rotate (orbit) around the central spindle with the bearing rings 34** without rotating themselves.

At the same time cog wheel 109 is effectively connected to a threaded spindle 108 via the cog wheel on spindle 37 and the intermediate gear 104. This effects the advance of a laying slide 113 with the half-nut 114, described later.

Figure 15:
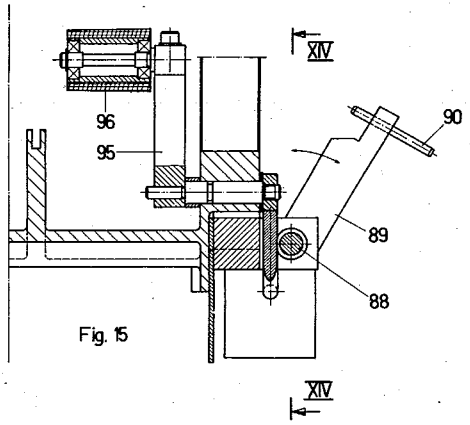
FIG. 15 is a cross sectional view taken along line XV—XV in FIG. 14.
Figure 14:
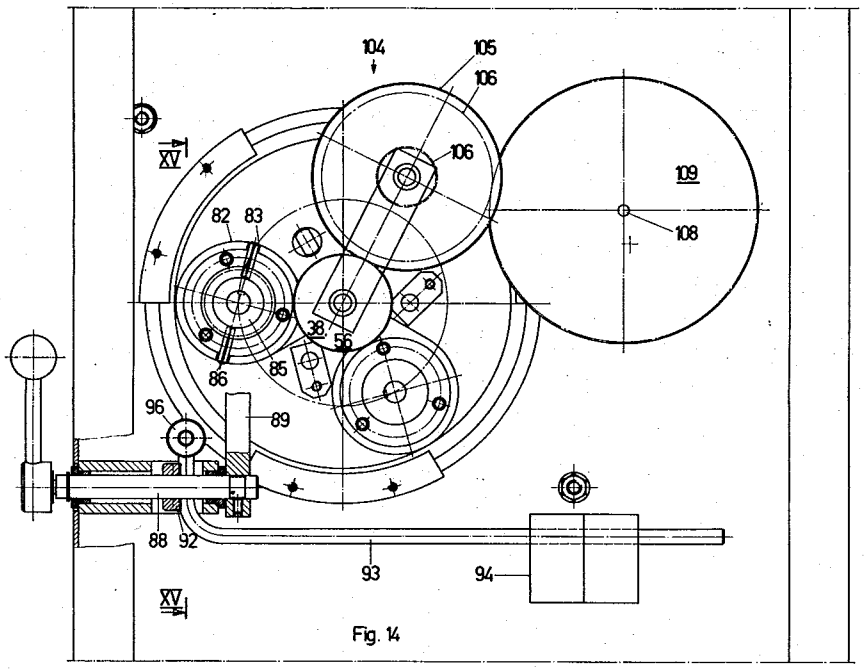
FIG. 14 is a side view of the thread-treating machine seen from the operator's side with parts cut away.
Figure 16:
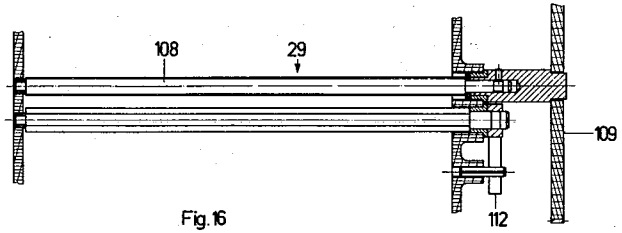
FIG. 16 is a cross sectional view taken along line XVI—XVI in FIG. 8 and FIG. 10 respectively.

Referring to FIGS. 14 and 15, on one side of the movable part of mercerizing station 31, there is a swivelling spindle 88 with a swivel lever 89 in housing 74 which carries safety bolt 90 on its free end. Furthermore, there is an eccentric ring 92 on the swivelling spindle 88 which lifts or releases a weighted arm 93 when swivelling spindle 88 is moved. In its turn, this arm moves a swivel lever 95 with a squeeze roller 96, in order to bring it against one of the thread rollers or to lift it from the roller.

As shown in FIGS. 8 and 9 two filling rods 98 are attached to a swivelling spindle 99 as an additional part of mercerizing station 31. Each rod 98 is ridged with 100 teeth around its circumference. A grip 101 attached to swivelling roller 99 permits moving filling rod 98 in and out of working position. A bullet catch 102 holds it in the desired position.

Cog wheel 38 on the central spindle 37 of the central drive is drive-connected with an alternating cog wheel 106 of the same spindle, by means of cog wheel 105; the first cog 38 therefore drives the threaded spindle 108 via its cog wheel 109. The many-edged guide rod 111 is designed to guide the laying slide 113 with the half-nut 114. To make sure that the half-nut 114 remains in contact with the threaded spindle 108, a tension spring 112 is attached to guide rod 111, which puts slide 119 under tension.

A carding device 116 with a swivelling spindle 117 is also a part of the mercerizing station 31. The carding disks 118 are set up along this swivelling spindle. These disks preferably are in the form of equilateral triangles and can each be rotated 120° by means of a square 119 and of spindle 117.

A 3-position tap 123 can be used to fill housing 74 of the mercerizing station 31 with a treating fluid for mercerizing with lye. The housing is emptied through an inlet/outlet nozzle 122 when tap 121 is in the proper corresponding position. Overflow 123 which is connected with a backflow nozzle 124 protects the entire against an excessive level of lye.

Attaching nozzles 125 are provided in the housing 74 of the mercerizing station 31, especially in its lower half, between two rollers for spraying the thread with treating fluids, has been demonstrated to be the optimum solution. These fluids run off the thread and through tap 121 into the run-off nozzle 122. As a result of this arrangement, which prevents the splashes associated with the use of a steeping bath, the run-through thread speeds can be increased substantially. The spraying can be done from the inside of the reel, from the outside, from above, below or from several sides and also from several directions at once, for example.

Wash station 48, as shown in FIGS. 3, 10 and 11, is constructed in a manner similar to mercerizing station 31. It also has a housing 127 with a cover 128 and a slip-on disk 129. Housing 127 is subdivided by a pair of dividing walls wall 131. Dividing flanges 132 are situated on the central spindle 55, on the opposite side of the axis from dividing walls 131. The surface area of the dividing flange is fitted with a thread guiding part. Sealing the chambers thus formed between dividing walls 131 and the dividing flanges 132 is done by means of gasket rings 134 which have been fitted with a hose 135 and a corresponding rubber bearing application 136.

In addition to this, thread rollers 50 and 51, as well as the bearing rings 52 and 53 have been constructed in an analogous way to the mercerizing station 31. Parts 50, 51, 52, 53, 55 also make up a reel 30. They are driven by means of intermediate gear 39 and the central drive motor 40. In contrast to the mercerizing station 31, in which the thread rollers have a shrinking and stretching cone and a cylindrical middle part, the thread rollers of wash station 48 are wholly cylindrical. It should be noted that the shape of the rollers of the mercerizing station are determined by the shrinking and stretching characteristics of the product and can, therefore, exhibit specific forms; they can also be completely cylindrical. It is possible that these rollers may consist only of two cones and do not have a cylindrical middle part; i.e., have only a shrinking and a stretching cone, as the case may be.

Furthermore, in special cases, it is possible that non-cylindrical rollers, or rather, not completely cylindrical rollers have to be provided.

Figure 12:
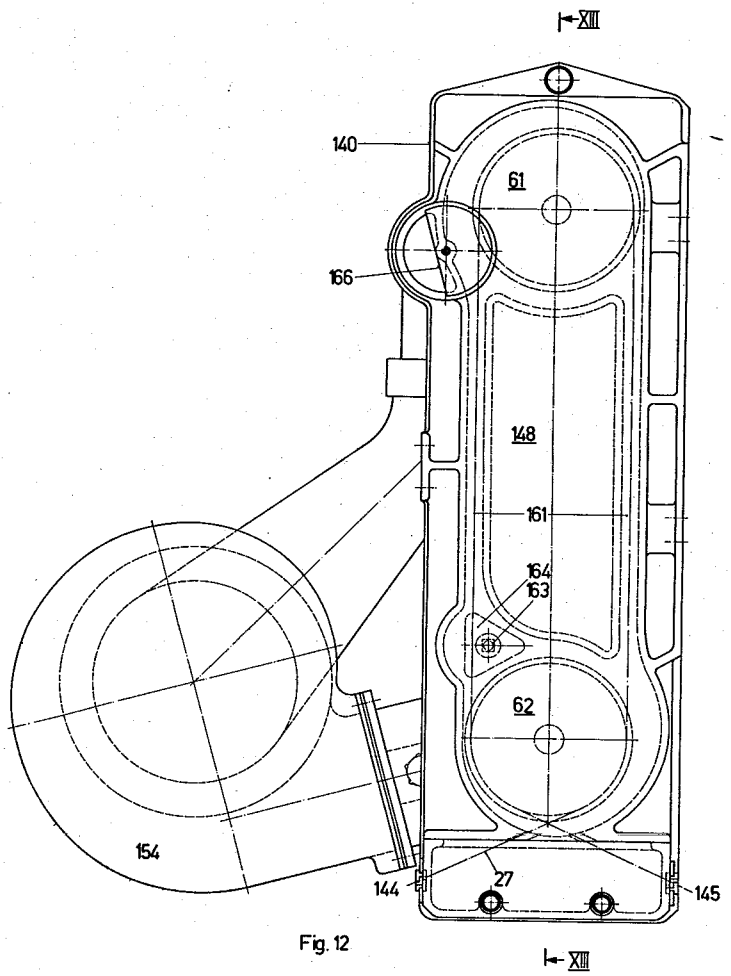
FIG. 12 is a front view of a drying station.
Figure 13:
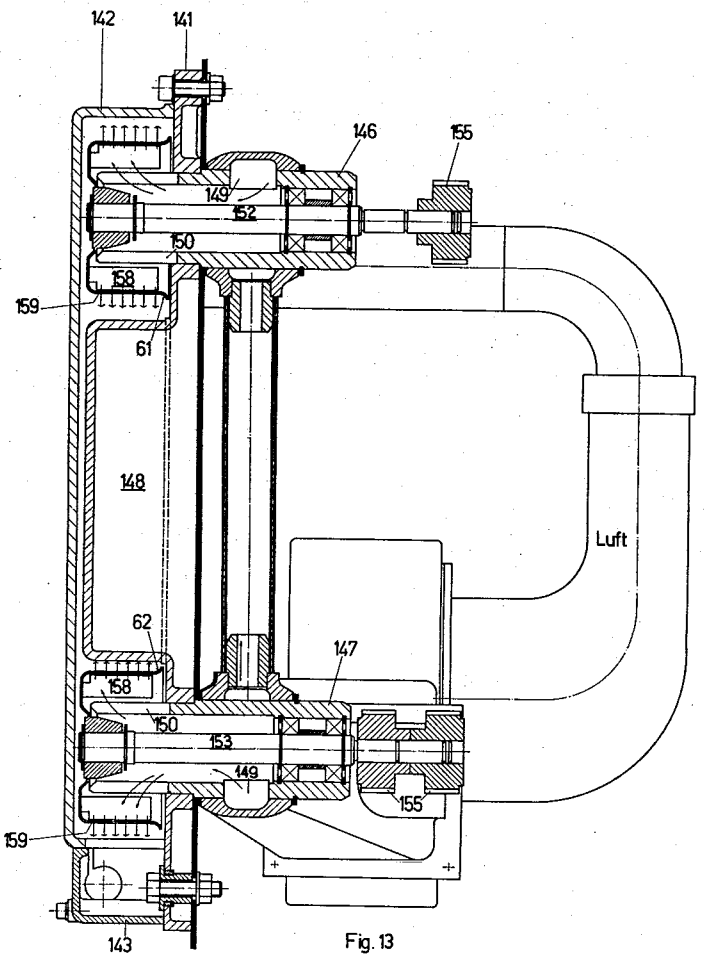
FIG. 13 is a cross sectional view of the drying station of FIG. 12 taken along line XIII—XIII.

The drying chamber 140 shown in FIGS. 12 and 13 has a part 141 shaped as a bottom plate and a swivelling top part 142. In addition, there is an unmovable forward section 143 of the bottom part, which forms a chamber. The sides of this front part have been fitted with two thread guides 144 and 145. The perforated rollers 61 and 62, attached to spindles 152 and 153, are driven by the drive motor 40 from the central drive by means of toothed belts 156 running over crown gears 155. The top perforated roller 61 on spindle 152 is free to turn and rests on the top of a hollow 146. The same is true for the lower roller 62 on spindle 152 which rests in a hollow 147. These hollows, 146 and 147, are equipped with air slots 149 which bring in air from the fan to the inside of perforated rollers 61 and 62 going via spindles 152 and 153 and the radial air slot 150 of the hollows 146 and 147. Both rollers 61 and 62 have been equipped with ventilating fins 158 which increase the velocity of air coming in through air slot 150 and blow it out through the openings 159 in the surfaces of rollers 61 and 62. The parts of the drying chamber 140, namely the bottom part 141 and the swivelling top part 142, are shaped in such a way that air channels 161 are formed as a result. Through these channels, the drying air is circulated by fan 154, permitting inflow of fresh air if so desired, at a speed suitable to aid the drying.

To lead the thread correctly onto the perforated rollers 61 and 62, a carding shaft 163 with carding disks 164 has been provided. This shaft 163 also can be made to turn and the disks made in triangular form, as are the similar portions of the mercerizing and wash station. An air regulating disk 166 controls the volume of fresh air in circulation thereby setting the optimum humidity for the grade of thread and the degree of drying.

A preliminary set-up procedure is necessary first of all, in order to operate the thread treating machine in a continuous production. For this reason, thread 27 is pulled off one spools 11 or 12. It would be possible to lead the thread to be treated directly; i.e., without intermediate spooling, from the preceding treating or manufacturing machine. The end of the thread in question is drawn off by the thread drawing-off device through the thread guide 15 and the thread brake 16, and is led by means of a diverting roller 17 to the threadmonitoring station 19. Here the thread is pulled through one of the thread-guiding rings 26 and placed over the diverting roller 23. The thread is subsequently pulled through the same thread-guiding ring 26 and placed into the thread-guide 46 of the laying device 46. The end of the thread is attached to the squeeze roller 42. Since the thread roller has been blocked by means of the free running bearing ring 85 in the manner described above, the drive motor 40 will drive the one bearing ring 34 via intermediate gear 39 and the drive cog wheel when the mercerizing station 31 is put into operation. As a result, the entire structure consisting of rings 34 and rollers 32, 33 turns about the axis of the central spindle 37. The thread attached to squeeze roller 42 is wound up in this manner. Guiding the thread while winding up is done with the aid of the thread guide 28 on the laying device 29 in the manner desired. The advance of the thread guide 28, caused by the turning of the threaded spindle 108, can be modified through the appropriate choice of cog wheels 38, 105 and 109, and especially through the choice of alternating cog wheel 106. This gives the possibility of changing the amount of thread wound-up, or rather the length in meters, in the manner desired. When the winding-up process is done and the rollers have been covered by the formed thread, the end of the thread held by squeeze roller 42 is pulled around the diverting roller 43 and into the laying device via the thread guide 45. The end of the thread is attached correspondingly to the squeeze roller 57 on the bearing ring 52 of the wash station 48. Now the wound-up thread can be mercerized in the mercerizing station 31. For this purpose, the three thread rollers 32 and 33 are to be unblocked. The bearing ring 34, not driven by cog wheel, is stopped by pushing up the swivelling lever 89. When the two stations 31 and 48 are driven by the drive motor 40 via the intermediate gear 39, thread rollers 32 and 33 turn about their own axes with the bearing rings 34, 35 at rest. Before beginning operation, the mercerizing station is still filled via the three-way tap 123 with the fluid intended for treating the thread, in this case with lye. Here a small amount is continuously permitted to overflow through overflow tap 123 into the backflow nozzle 124, in order to permit fresh lye to enter continuously.

Insofar as the thread rollers 32 and 33 have been fitted with a shrinking cone, this shrinking process must be taken into account by turning grips 101, thereby also the swivelling spindles 99, bringing the filling rods 98 into working position. This results in an increase in the circumference covered by the thread during spooling. This represents a compensation for the shrinkage that occurs with treatment with NaOH. These filling rods 98 are put back into neutral position before filling the mercerizing station with treatment lye, so that the thread can shrink by the appropriate amount and be free of tension.

The thread rollers 50 and 51 in the wash station are to be blocked in the manner described, so that the thread is wound up there, during which time the thread is being mercerized in mercerizing station 31. There is no need for additional synchronizing the apparatus since the drive motor 40 operates the drive of both the turning parts of the wash station 48 as well as that of the mercerizing station 31.

The process is considered finished when the thread wound up in the wash station covers the thread rollers in the manner desired.

When winding-up the thread in wash station 49, the thread has to be fed in by hand through the thread guiding parts 133 of the dividing flange 132 to ensure that the forming thread is led from one treatment chamber into the other.

After this process, thread rollers 50 and 51 are unblocked and bearing rings 52 and 53 are blocked in the same way as is done with the mercerizing station. Following this, the thread is led from squeeze rollers 57 in the diverting roller 58 to the thread monitoring station 19, where it is once again fed in through the appropriate thread guide ring 26. The thread is then wrapped around the proper diverting roller and is pulled through the same ring 26 to the outside to the drying station 60.

Wrapping the perforated rollers 61 and 62 with a similar thread, a socalled precursor, is also another part of the preparation procedure done to this point. One end of the precursor is led to spool station 65 and the other end is connected to the end of the thread that comes from the wash station. The free end of the thread which has been fed into spool station 65 is secured in the usual manner to the sleeve. Now the preparation process is done, and the machine is basically ready to take over the continuous operation of treatment, mercerizing in this case, thereby treating the thread introduced into the thread treating machine continuously.

However, a treatment of the thread can take place in some other manner corresponding to the treatment baths and the operating data chosen. Thus the thread can also be treated in color baths and the like, the dying process taking place either in a vacuum or perhaps under elevated pressure.

The appropriate baths are to be made ready at the stations before starting up the thread treating machine.

This is done by means of appropriate three-way taps (not shown) for the wash station. In the case of mercerizing, for example, the first bath could be hot water, followed by an acid treatment bath, after which the thread can be subjected to either a color revival or a washing out process. The latter is again done with hot water with the appropriate additives. Drying station 60 uses circulated air sucked in through ventilator 159 and which is conducted to the two hollow naves 146 and 147 from the pressure side. Fitting rollers 61 and 62 with ventilator fins 158 gives the air additional momentum which has a correspondingly favorable effect on the drying time, due to the higher air velocity.

As the following representation shows, a thread mercerized in the continuous process on a machine as described is superior in quality to the one treated in a strand. In addition, the treatment saves a considerable amount of labor as well as increasing uniformity.

The basic equipment of such a machine essentially comprises the following parts:

(1) a carrying device for spool feed in magazine form;
(2) two chambers for wet treatments;
(3) one dryer station;
(4) one spool station;
(5) one central drive group;
(6) one set of electric equipment, including thread monitoring.

Of course, central supervision and operation is provided for this thread treating machine, which is based on established temperatures, and their limits, at the most important places.

It is also possible to keep bath compositions, concentrations and temperatures to SOLL-values, or as the case may be, to let prescribed programs run through. As mentioned, it is practical to provide for a central drive when setting up entire groups of machines so that the individual machines and their stations can be put into and out of operation through appropriate coupling maneuvers. Monitoring such plants demands, as shown, fitting the machines with signal lamps or sound signals to show the operating personnel appropriate shut downs.

The above mentioned conditions for optimum mercerization can be fulfilled in the wet treatment machine at hand in an ideal manner, which is shown in a test series with twisted cotton thread Ne 60/2 (about Nm 100/2).

The raw thread designated for experiment 1 was mercerized at different settings:

Experiments 2–8 used a continuously running single thread

Experiment number 9 was run in skein-form on a Jaeggli skein thread mercerizing machine of the typ MM-8.

The results of the EMPA tested threads can be seen in the following tables I–IV.

TABLE I

| Experiment No. | IMAG - Test Paper: Lye Treatment: Shrinkage | Tension | NaOH | Temp. | Time | Treatment Parameters: 1. Warm H2O: Temp. | Time | Acid: Temp. | Time | 2. Warm Water: Temp. | Time | F |
|---|---|---|---|---|---|---|---|---|---|---|---|---|
| 1 | Raw Thread, singed | | Ne 60/2 | (ca. Nm100/2) | | | | | | | | |
| 2 | 6% | 1% | 25% | 18° C. | 150 s | 80° C. | 47 s | 70° C. | 34 s | 70° C. | 34 s | C |
| 3 | 6% | 1% | 25% | 18° C. | 150 s | 80° C. | 47 s | 70° C. | 34 s | 70° C. | 34 s | E |
| 4 | 4% | 1% | 25% | 18° C. | 150 s | 80° C. | 47 s | 70° C. | 34 s | 70° C. | 34 s | C |
| 5 | 6% | 0% | 25% | 18° C. | 150 s | 80° C. | 47 s | 70° C. | 34 s | 70° C. | 34 s | C |
| 6 | 4% | 1% | 25% | 60° C. | 150 s | 80° C. | 47 s | 70° C. | 34 s | 70° C. | 34 s | C |
| 7 | 0% | 4% | 25% | 18° C. | 150 s | 80° C. | 47 s | 70° C. | 34 s | 70° C. | 34 s | C |
| 8 | 6% | 1% | 25% | 18° C. | 120 s | 80° C. | 37 s | 70° C. | 27 s | 70° C. | 27 s | C |
| 9 | Values unknown: experiment carried out by customer | | | | | | | | | | | |

Column F = speed of thread:
Letter
A = 1.0 m/sec
B = 1.5 m/sec
C = 2.0 m/sec
D = 2.5 m/sec
E = 3.0 m/sec

TABLE II

Three cylindrical sleeves with cotton thread Ne 60/2
Sleeve No. 1: Raw thread, singed, unmercerized (model for Nos. 2 & 3)
Sleeves Nos. 2 & 3: Mercerized at various adjustments of the machine.
Thread Velocity—2m/sec—3m/sec

| TEST | SLEEVE No. 1 Raw | 2 6/1% | 3 6/1% |
|---|---|---|---|
| Barite No. | 100 | 158 | 149 |
| Degree of Mercerization | 1 | 8.9 | 7.5 |
| Equalization | | | |
| Shrinkage: Percent | 19.0 | 15.6 | 17.7 |
| Equalization | in order | uniform | uniform |
| Tensile Strength | | | |
| Normality texR | 20.8(2x) | 19.2(2x) | 19.0(2x) |
| Mean Tear Strength P | 459 | 540 | 584 |
| Mean Elongation (at tear) % | 6.8 | 3.3 | 3.1 |
| Gloss Number | 1.29 | 2.04 | 1.97 |

TABLE III

Three Cylindrical Sleeves with Cotton Thread Ne 60/2 Marked as Numbers 4–6

| TEST | —2m/sec— Sleeve No. 4 4/1% | 5 6/0% | NaOH 60° C. 6 4/1% |
|---|---|---|---|
| Barite No. | 141 | 145 | 138 |
| Degree of Mercerization | 6.3 | 6.9 | 5.8 |
| Tensile Strength | | | |
| Normality texR | 19.5 | 19.7 | 19.4 |
| Mean Tear Strength P | 553 | 548 | 551 |
| Mean Elongation (at tear) % | 3.2 | 3.5 | 3.1 |
| Gloss No. | 2.64 | 2.60 | 2.85 |

TABLE IV

Three Cylindrical Sleeves with Mercerized Cotton Thread Ne 60/2 Marked as Nos. 7–9

| TEST | —2m/sec—Skeins Sleeve No. 7 0/4% | 8 6/1% | 9 |
|---|---|---|---|
| Barite No. | 142 | 146 | 143 |

TABLE IV-continued

Three Cylindrical Sleeves with Mercerized Cotton Thread Ne 60/2 Marked as Nos. 7–9

| TEST | —2m/sec—Skeins Sleeve No. 7 0/4% | 8 6/1% | 9 |
|---|---|---|---|
| Degree of Mercerization | 6.5 | 7.1 | 6.6 |
| Tensile Strength | | | |
| Normality texR | 19.2 | 19.5 | 19.0 |
| Mean Tear Strength P | 563 | 585 | 529 |
| Mean Elongation (at tear) % | 2.63 | 3.41 | 4.97 |
| Gloss No. | 2.87 | 2.75 | 2.44 |
| Equalization | Not done | Not done | see Enclosure |

Thus, such a mercerized thread exhibits the following values when optimum mercerization has taken place:

Barite number $150 \leqq x \leqq 165$; the preferred range being $153 \leqq x \leqq 160$ and the increase in tensile strength is in the range $15 \leqq y \leqq 50\%$, preferably $15 \leqq y \leqq 30\%$.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for treating thread formations comprising:

providing a first wetting station for treating a thread formation, said first wetting station having a first reel comprising a central spindle rotatably mounted in a housing along a first axis and a plurality of rollers each rotatably mounted about said central spindle in said housing along axes parallel to said first axis;

providing drive means operatively engaging said first reel, said drive means being operative in a first condition wherein said spindle rotates on said first axis while said rollers orbit about said spindle and a second condition wherein said spindle is stationary and said plurality of rollers rotate on their axes respectively;

mounting thread guide means for axial movement on a second axis parallel to and spaced apart from said first axis for feeding said thread formation over the length of said first reel;

feeding said thread formation to said thread guide means and said first reel when said drive means is operatively engaging said first reel in said first condition for spooling said thread formation on said first reel;

providing a treatment bath in said housing of said first wetting station;

treating the spooled-up thread formation on said first reel in said treatment bath; and feeding the treated thread formation off of said first reel when said drive means is in said second condition so as to treat said treated thread formation.

2. A process according to claim 1 further including the steps of:

providing a second wetting station for washing said treated thread formation, said second wetting station having a second reel comprising a central spindle rotatably mounted in a housing along a third axis and a plurality of rollers each rotatably mounted about said central spindle in said housing along axes parallel to said third axis;

providing drive means operatively engaging said second reel, said drive means being operative in a first condition wherein said spindle rotates on said third axis while said rollers orbit about said spindle and a second condition wherein said spindle is stationary and said plurality of rollers rotate on their axes respectively;

mounting thread guide means for axial movement on a fourth axis parallel to and spaced apart from said third axis for feeding said treated thread formation over the length of said first reel; and feeding said treated thread formation off of said first reel to said threaded guide means and said second reel when said drive means is operatively engaging said second reel in said first condition for spooling said treated thread formation on said second reel.

3. A process according to claim 2 further including the steps of:

providing washing means in said housing of said second wetting station;

washing the spooled-up treated thread formation on said second reel in said washing means; and feeding the washed treated thread formation off of said second reel.

4. A process according to claim 3 further including the step of feeding said washed treated thread formation off of said second reel to a drying station.

* * * * *